US012330198B2

(12) United States Patent
Sugimoto et al.

(10) Patent No.: US 12,330,198 B2
(45) Date of Patent: Jun. 17, 2025

(54) ROLLING MILLS AND ROLLING METHODS

(71) Applicant: PRIMETALS TECHNOLOGIES JAPAN, LTD., Hiroshima (JP)

(72) Inventors: Tatsunori Sugimoto, Hiroshima (JP); Kenji Horii, Hiroshima (JP); Akio Kuroda, Hiroshima (JP); Akira Sako, Hiroshima (JP); Shinya Kanemori, Tokyo (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 241 days.

(21) Appl. No.: 17/914,776

(22) PCT Filed: Apr. 17, 2020

(86) PCT No.: PCT/JP2020/016934
§ 371 (c)(1),
(2) Date: Sep. 27, 2022

(87) PCT Pub. No.: WO2021/210175
PCT Pub. Date: Oct. 21, 2021

(65) Prior Publication Data

US 2023/0330729 A1 Oct. 19, 2023

(51) Int. Cl.

| | |
|---|---|
| ***B21B 37/68*** | (2006.01) |
| ***B21B 1/22*** | (2006.01) |
| ***B21B 38/00*** | (2006.01) |
| ***B21B 38/04*** | (2006.01) |
| ***B21B 38/06*** | (2006.01) |
| ***B21B 39/16*** | (2006.01) |

(Continued)

(52) U.S. Cl.
CPC ..... *B21B 37/68* (2013.01); *B21B 1/22* (2013.01)

(58) Field of Classification Search
CPC ..... B21B 37/68; B21B 1/22; B21B 38/00; B21B 38/04; B21B 38/06; B21B 39/16; B21D 5/14; G01B 11/022
USPC ..... 72/14.4–14.6, 10.4–10.6
See application file for complete search history.

(56) References Cited

U.S. PATENT DOCUMENTS

| | | | | |
|---|---|---|---|---|
| 2014/0007637 | A1 | 1/2014 | Hayashi et al. | |
| 2014/0305179 | A1* | 10/2014 | Ishii | B21B 38/08 72/241.2 |
| 2021/0229148 | A1* | 7/2021 | Ishii | B21B 31/02 |

FOREIGN PATENT DOCUMENTS

| | | | |
|---|---|---|---|
| JP | 07-171608 | A | 7/1995 |
| JP | 5533754 | B2 | 6/2014 |
| JP | 2020-040097 | A | 3/2020 |

(Continued)

OTHER PUBLICATIONS

International Search Report of PCT/JP2020/016934 dated Jul. 14, 2020.

*Primary Examiner* — Mohammed S. Alawadi
(74) *Attorney, Agent, or Firm* — MATTINGLY & MALUR, PC

(57) ABSTRACT

A control device 20 obtains second pressing forces acting on work-side and drive-side roll chocks 112A and 112B on the basis of entry side and exit side first pressing forces, and controls at least one of work roll position control devices 140B and 141B and at least one of work roll pressing devices 130B and 131B changing a position of at least one of the roll chocks 112A and 112B in such a manner that a difference between the work-side second pressing force and the drive-side second pressing force is equal to or smaller than a predetermined value.

12 Claims, 13 Drawing Sheets

(51) Int. Cl.
*B21D 5/14* (2006.01)
*G01B 11/02* (2006.01)

(56) References Cited

FOREIGN PATENT DOCUMENTS

| | | | |
|---|---|---|---|
| WO | 2012/086043 | A1 | 6/2012 |
| WO | 2014/003014 | A1 | 1/2014 |

* cited by examiner

ROLLING MILLS AND ROLLING METHODS

TECHNICAL FIELD

The present invention relates to rolling mills and rolling methods.

BACKGROUND ART

Patent Document 1 describes an example of tandem rolling facilities that sufficiently control strip crown/shape by applying strong roll bending forces, and furthermore reduce the occurrence of strip movement along lateral direction, cambers, and warping in thick plate rolling mills and hot rolling roughing mills, and describes an example of stable and additionally highly efficient rolling methods using the tandem rolling facilities. The tandem rolling facility described in Patent Document 1 includes a plurality of rolling mills. Each rolling mill includes an upper work roll inner chock and an upper work roll outer chock supporting an upper work roll, a rolling direction force applied to a body portion of a lower work roll is supported by a contact surface between a project block and a lower work roll chock, a rolling direction force applied to a body portion of the upper work roll is supported by a contact surface between the upper work roll inner chock and a rolling mill housing window positioned above the project block, and the upper work roll chocks receive increase bending forces from hydraulic cylinders.

In addition, Patent Document 2 describes an example of roll cross rolling-mill control methods that prevent the strip movement along lateral direction and a thickness difference along width direction of a rolled material. According to Patent Document 2, in a cross rolling mill including upper and lower work rolls having a cross mechanism, an off-center amount between a cross point and the mill center or strip center is used as a setting item to control the upper and lower work rolls in such a manner that their cross angles are different from each other, to thereby prevent the strip movement along lateral direction and a thickness difference along width direction of a rolled material.

PRIOR ART DOCUMENT

Patent Documents

Patent Document 1: Japanese Patent No. 5533754
Patent Document 2: JP-1995-171608-A

SUMMARY OF THE INVENTION

Problem to be Solved by the Invention

In rolling work of a metallic strip, the crown and shape of the rolled strip are used as important quality indicators, and technologies related to strip crown/shape control have been disclosed.

For example, Patent Document 1 discloses reduction of cambers or the like of a rolled material by measuring rolling direction forces (horizontal forces) acting on the work roll chocks, and controlling a gap difference between the upper and lower rolls (leveling) on the basis of a left-right difference between rolling direction forces on the work side and the drive side.

In addition, Patent Document 2 discloses control of strip movement along lateral direction and a strip thickness difference (strip wedge) of a rolled material by computing an off-center amount and a strip wedge from signals sensed by a width end position sensor and a strip profile meter, and setting the cross angles of the upper and lower work rolls individually.

However, in Patent Document 1 mentioned above, there is a limitation on leveling control by control of reduction devices above the chocks, and there is room for further improvement for precise control of strip wedges of both the work side and the drive side. In addition, there is a problem about leveling control that if the gap is controlled in a wrong direction, strip wedges are generated suddenly, and rolling can become unstable easily.

In Patent Document 2, whereas the width end position sensor and the strip profile meter are included as sensors for information used for control, typically, the strip profile meter is installed on an exit side of the last finishing rolling mill, and is not installed between stands.

In addition, even if the roll cross angles are actually adjusted to set values, the roll position cannot be set to an accurate position due to backlashes or the like that occur in a facility; as a result, the roll cross angles can undesirably be unintended roll cross angles. Accordingly, there is a limitation about geometrical computation of cross angles from these pieces of information, and adjustment of the cross angles, and it has become clear that there is room for further improvement for precisely controlling strip wedges.

The present invention provides rolling mills and rolling methods that make it possible to more easily and additionally precisely control strip wedges as compared with conventional technologies.

Means for Solving the Problem

The present invention includes a plurality of means for solving the problems described above, and an example thereof is a rolling mill including: a pair of upper and lower work rolls; roll chocks that rotatably support the work rolls; a plurality of pressing devices that are provided on an entry side and an exit side of the roll chocks in a rolling direction, and on a work side and a drive side, and are configured to be capable of changing positions of the roll chocks in the rolling direction, and also measuring first pressing forces on the roll chocks; and a control device that drives the pressing devices, and controls the positions of the roll chocks, in which the control device obtains second pressing forces acting on the roll chocks on the work side and the drive side on a basis of the first pressing forces on the entry side and the exit side, and drive-controls at least one of the plurality of pressing devices changing a position of a roll chock of at least one of the pair of upper and lower work rolls in such a manner that a difference between the second pressing force on the work side and the second pressing force on the drive side is equal to or smaller than a predetermined value.

Advantages of the Invention

According to the present invention, it is possible to more easily and additionally precisely control strip wedges as compared with conventional technologies. Problems, configurations, and advantages other than those described above are made clearer by the following explanation of embodiments.

MODES FOR CARRYING OUT THE INVENTION

Figure 1:
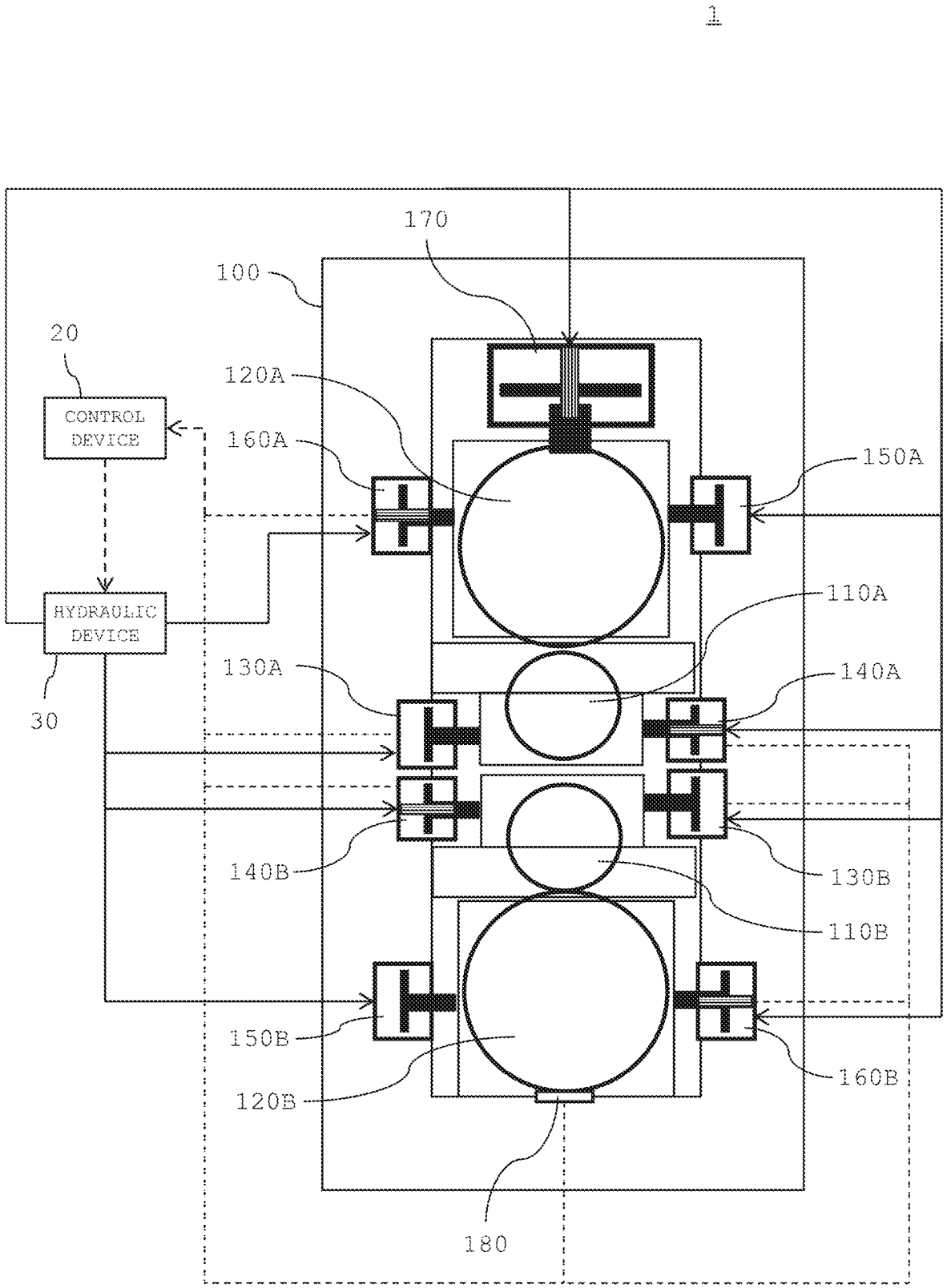
FIG. 1 is a front view of a four-high rolling mill which is a rolling mill according to a first embodiment of the present invention, and is provided with a hydraulic pressure device on one side and a position control device on the other side.

Embodiments of rolling mills and rolling methods according to the present invention are explained below by using the figures. Note that identical or corresponding constituent elements in the figures used in the present specification are given identical or similar reference characters, and repetitive explanations of these constituent elements are omitted in some cases.

In addition, in the following embodiments and figures, a drive side (also written as a "DS (Drive Side)") means a side where electric motors to drive work rolls are installed when a rolling mill is seen from its front side, and a work side ("WS (Work Side)") means the opposite side.

First Embodiment

A first embodiment of rolling mills and rolling methods according to the present invention is explained by using FIG. 1 to FIG. 7.

Figure 2:
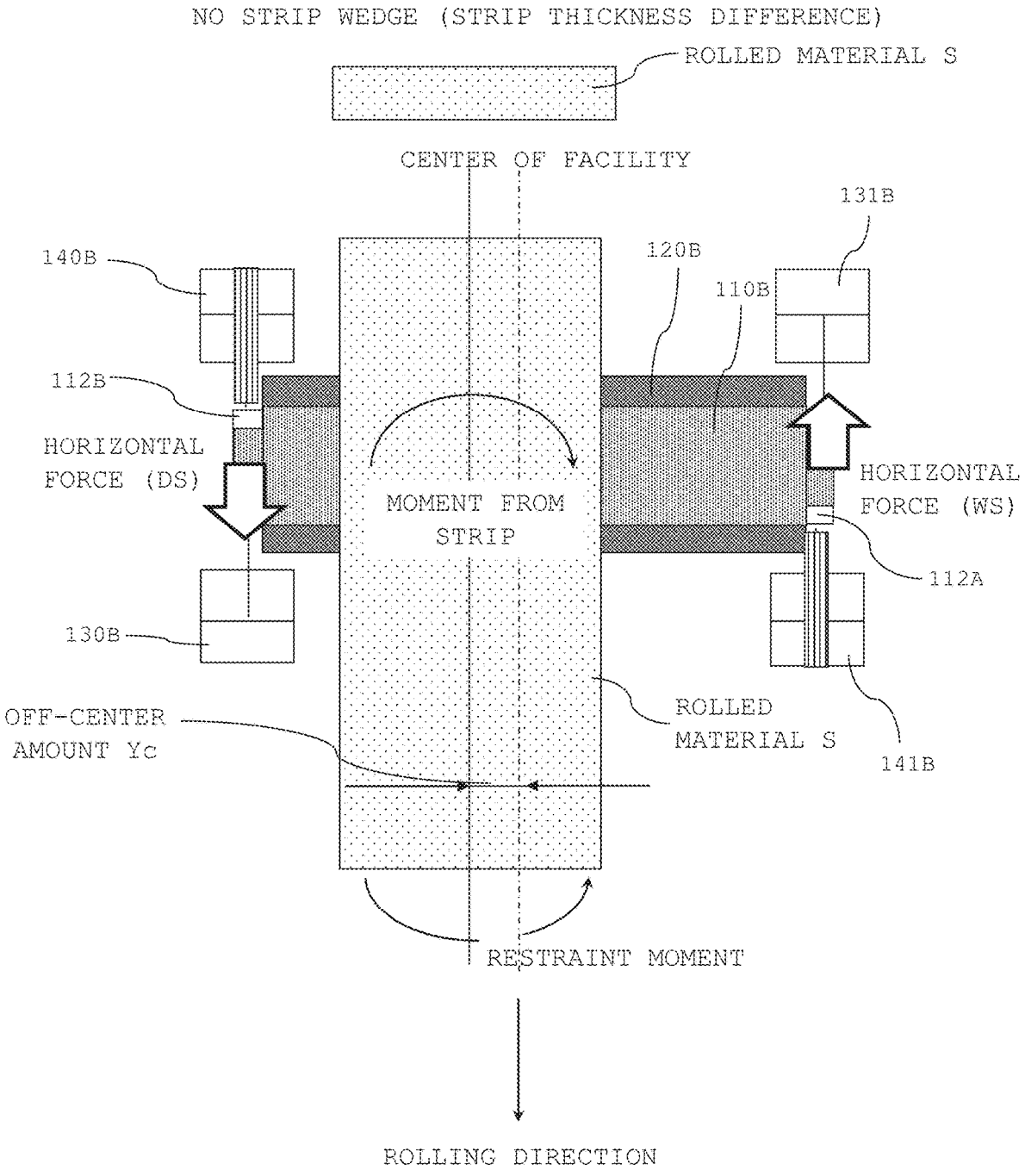
FIG. 2 is an enlarged view of a lower work roll portion of the rolling mill according to the first embodiment.

First, the overall configuration of a rolling mill according to the present embodiment is explained by using FIG. 1 and FIG. 2. FIG. 1 is a front view of a four-high rolling mill according to the present embodiment. FIG. 2 is an enlarged view of lower work roll and lower backup roll portions in the rolling mill in FIG. 1.

In FIG. 1, a rolling mill 1 is a four-high pair cross rolling mill that rolls a rolled material S, and has a housing 100, a control device 20, and a hydraulic device 30. Note that the rolling mill is not limited to an one stand rolling mill like the one depicted in FIG. 1, and may be a rolling mill including two stands or more.

The housing 100 includes a pair of an upper work roll 110A and a lower work roll 110B that are provided on the upper side and lower side, a pair of an upper backup roll 120A and a lower backup roll 120B that support the work rolls 110A and 110B, and are provided on the upper side and lower side.

Reduction cylinders 170 are cylinders that apply rolling reduction forces to the upper backup roll 120A, the upper work roll 110A, the lower work roll 110B, and the lower backup roll 120B by pressing the upper backup roll 120A. The reduction cylinders 170 are provided on the work side and drive side in the housing 100.

A load cell 180 is provided at a lower portion of the housing 100, as rolling force measurement means for measuring a rolling force of the rolled material S applied by the work rolls 110A and 110B, and outputs measurement results to the control device 20.

The hydraulic device 30 is connected to hydraulic cylinders of work roll pressing devices 130A and 130B and work roll position control devices 140A and 140B, and the hydraulic device 30 is connected to the control device 20. Similarly, the hydraulic device 30 is connected to hydraulic cylinders of backup roll pressing devices 150A and 150B and backup roll position control devices 160A and 160B.

The control device 20 receives input of measurement signals from the load cell 180 and position measuring instruments of the work roll position control devices 140A and 140B and the backup roll position control devices 160A and 160B.

The control device 20 actuation-controls the hydraulic device 30, supplies and discharges a hydraulic fluid to and from hydraulic cylinders of the work roll pressing devices 130A and 130B, a work roll pressing device 131B, and the work roll position control devices 140A and 140B to thereby drive those hydraulic cylinders, and changes the positions of roll chocks 112A and 112B (see FIG. 2) supporting the work rolls 110A and 110B.

Similarly, the control device 20 actuation-controls the hydraulic device 30, supplies and discharges a hydraulic fluid to hydraulic cylinders of the backup roll pressing devices 150A and 150B and the backup roll position control devices 160A and 160B to thereby drive those hydraulic cylinders, and changes the positions of roll chocks (illustrations omitted) supporting the backup rolls 120A and 120B.

Next, configuration related to the lower work roll 110B is explained by using FIG. 2. Note that since the upper work roll 110A, the upper backup roll 120A, and the lower backup roll 120B also have equivalent configuration, and detailed explanations thereof are approximately the same also, the explanations thereof are omitted.

The housing is positioned on both end sides of the lower work roll 110B of the rolling mill 1, and is provided to stand perpendicular to the roll shaft of the lower work roll 110B.

The lower work roll 110B is rotatably supported by the housing 100 via the work-side roll chock 112A and the drive-side roll chock 112B.

A work roll position control device 141B is arranged between the exit side of a work-side portion of the housing 100 and the work-side roll chock 112A, and has a hydraulic cylinder that adjusts the position of the roll chock 112A of the lower work roll 110B in the rolling direction. The work roll position control device 141B includes a position measuring instrument (illustration omitted) that measures the amount of operation of the hydraulic cylinder, and adjusts the position of the hydraulic cylinder to thereby change the position of the roll chock 112A.

Here, in the present embodiment, a position control device means a device that measures the cylinder stroke position of a hydraulic cylinder as a pressing device by using a position measuring instrument incorporated in the position control device, and controls the cylinder stroke position until the cylinder stroke position becomes a predetermined position. All position control devices to be explained hereinafter also have similar meanings.

The work roll pressing device 131B is arranged between the entry side of the work-side portion of the housing 100 and the work-side roll chock 112A, and presses the roll chock 112A of the lower work roll 110B in the rolling direction along with the position adjustment by the work roll position control device 141B in such a manner that a constant pressing force is maintained, to thereby change the position of the roll chock 112A.

The work roll position control device 140B is arranged between the entry side of a drive-side portion of the housing 100 and the drive-side roll chock 112B, and has a hydraulic cylinder that adjusts the position of the roll chock 112B of the lower work roll 110B in the rolling direction. The work roll position control device 140B includes a position measuring instrument (illustration is omitted) that measures the amount of operation of the hydraulic cylinder, and adjusts the position of the hydraulic cylinder to thereby change the position of the roll chock 112B.

The work roll pressing device 130B is arranged between the exit side of the drive-side portion of the housing 100 and the drive-side roll chock 112B, and presses the roll chock 112B of the lower work roll 110B in the direction opposite to the rolling direction along with the position adjustment by the work roll position control device 140B in such a manner that a constant pressing force is maintained, to thereby change the position of the roll chock 112B.

All of these work roll position control devices 140B and 141B and work roll pressing devices 130B and 131B are configured to be capable of measuring first pressing forces on the roll chocks 112A and 112B.

Figure 3:
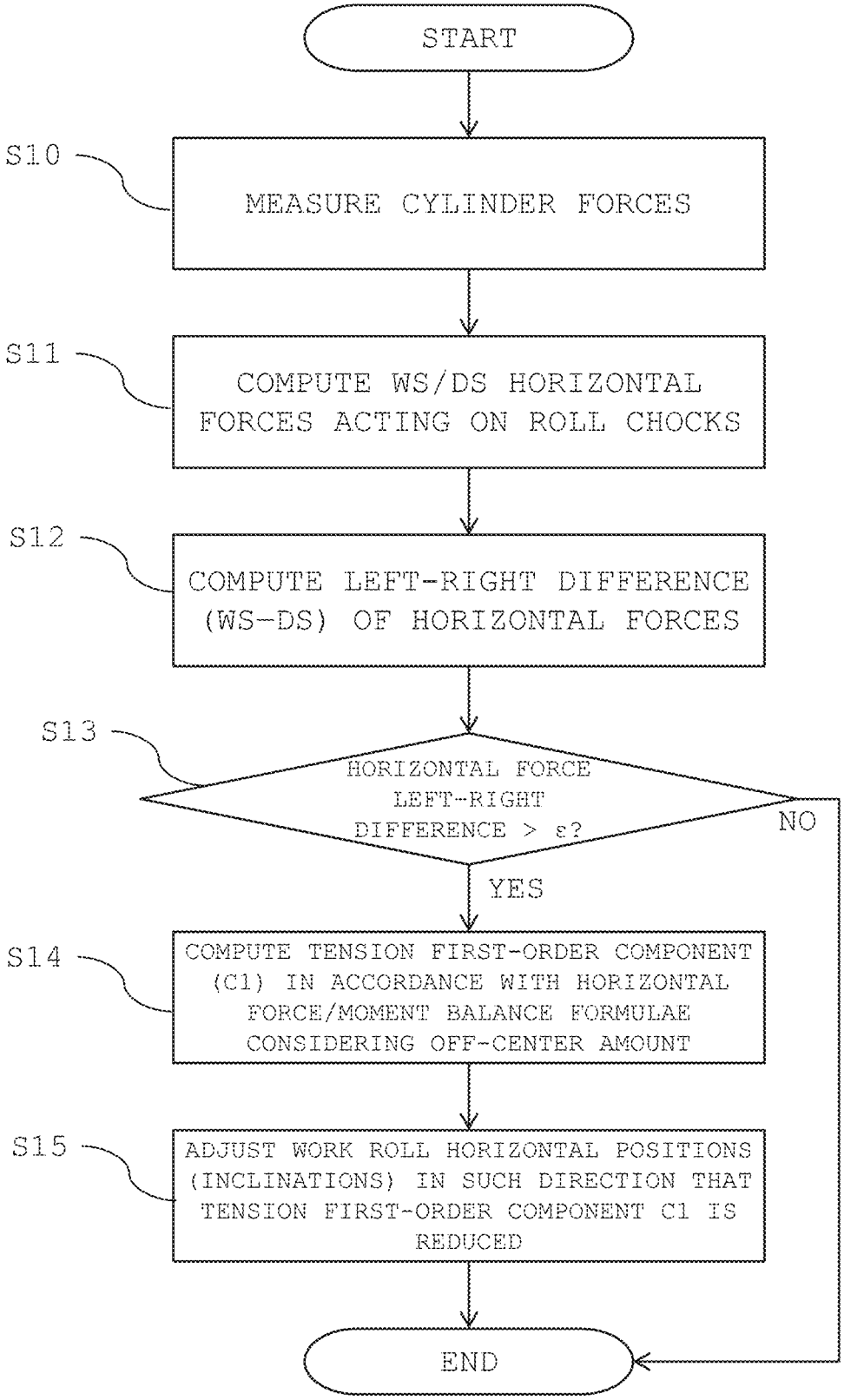
FIG. 3 is a flowchart depicting a procedure of control at a time of rolling in the rolling mill according to the first embodiment.

Next, details of control at a time of rolling in the rolling mill according to the present embodiment and a rolling method are explained with reference to FIG. 3 with reference to the lower work roll 110B. FIG. 3 is a flowchart depicting a procedure of control at a time of rolling in the rolling mill according to the first embodiment.

First, as depicted in FIG. 3, by the work roll position control devices 140B and 141B, the work roll pressing devices 130B and 131B and the like, pressing forces (first pressing forces) on the roll chocks 112A and 112B and the like supporting the work rolls 110A and 110B and the backup rolls 120A and 120B are measured (Step S10). The pressing forces may be measured at the hydraulic cylinders as in the present embodiment, but may be measured by using the load cell. Step S10 is equivalent to the pressing force measurement step of pressing the roll chocks 112A and 112B toward the entry side or exit side, and measuring the first pressing forces.

Next, the control device 20 obtains second pressing forces (horizontal forces) acting on the work-side and drive-side roll chocks 112A and 112B on the basis of the entry side and exit side first pressing forces measured at Step S10 (Step S11). Step S11 is equivalent to the pressing force calculation step.

Next, the control device 20 obtains a difference between the work-side second pressing force and drive-side second pressing force obtained at Step S11 (Step S12). Thereafter the control device 20 assesses whether or not the difference between the work-side second pressing force and drive-side second pressing force obtained at Step S12 is greater than a predetermined value ε (Step S13). When it is assessed that the difference is greater than the predetermined value ε, the process proceeds to Step S14. In contrast to this, when it is assessed that the difference is equal to or smaller than the predetermined value ε, the process ends.

Next, the control device 20 controls at least one of the work roll position control devices 140B and 141B and at least one of the work roll pressing device 130B and 131B changing the position of at least one of the roll chocks 112A and 112B in such a manner that the obtained difference between the work-side second pressing force and the drive-side second pressing force is equal to or smaller than the predetermined value. First, a tension first-order component is computed in accordance with horizontal force/moment balance formulae taking an off-center amount into consideration (Step S14). Here, in the present embodiment, a tension distribution is obtained supposing that the off-center amount is 0, and also a first-order component thereof is computed.

Next, the control device 20 adjusts the horizontal positions (inclinations) of the work rolls in such directions that the tension first-order component obtained at Step S14 decreases (Step S15), and the process ends.

The rolling mill 1 constantly executes each step depicted in FIG. 3 during rolling.

Figure 4:
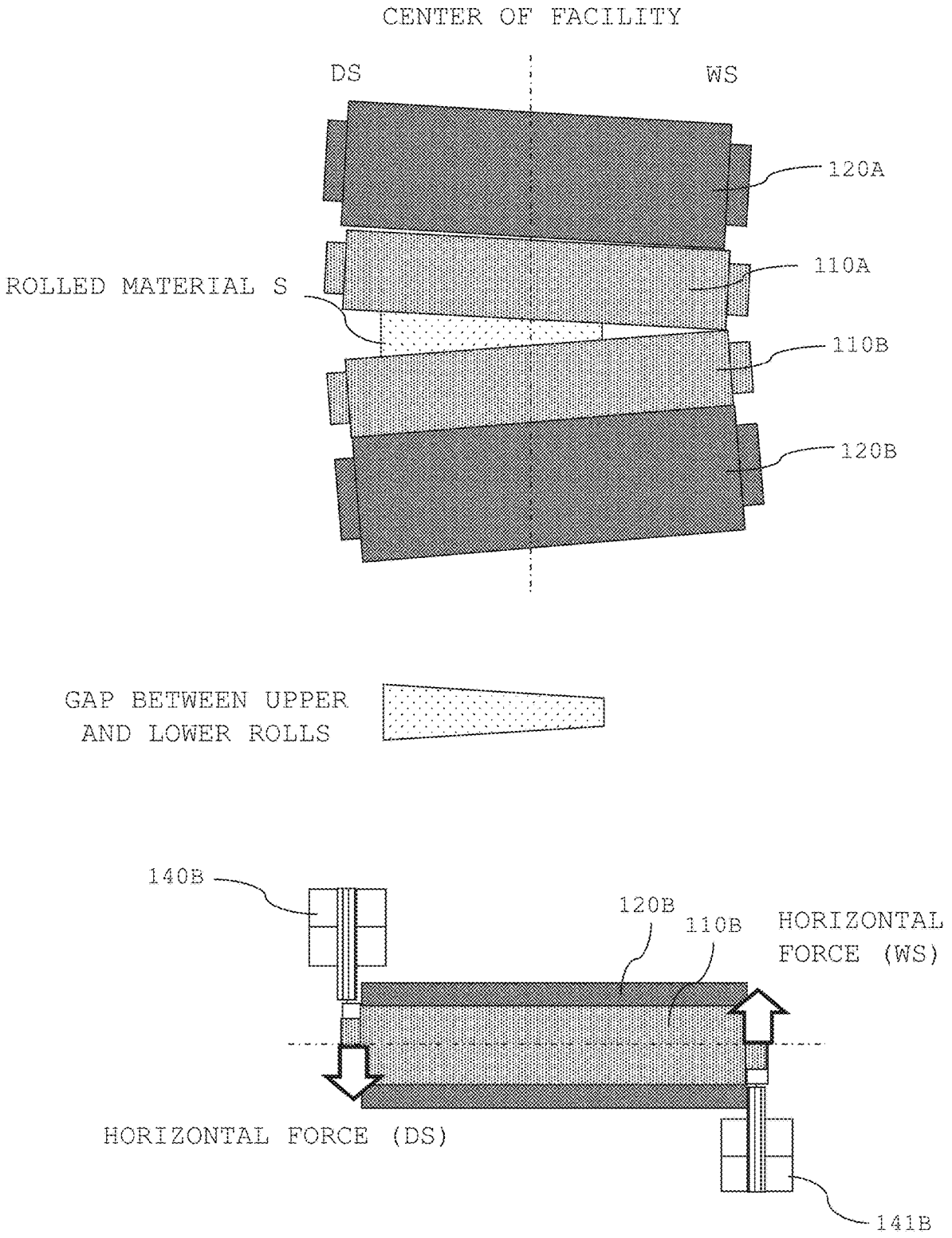
FIG. 4 is a figure depicting a state of a case where a rolled material is off-center in a rolling mill according to a comparative example.
Figure 5:
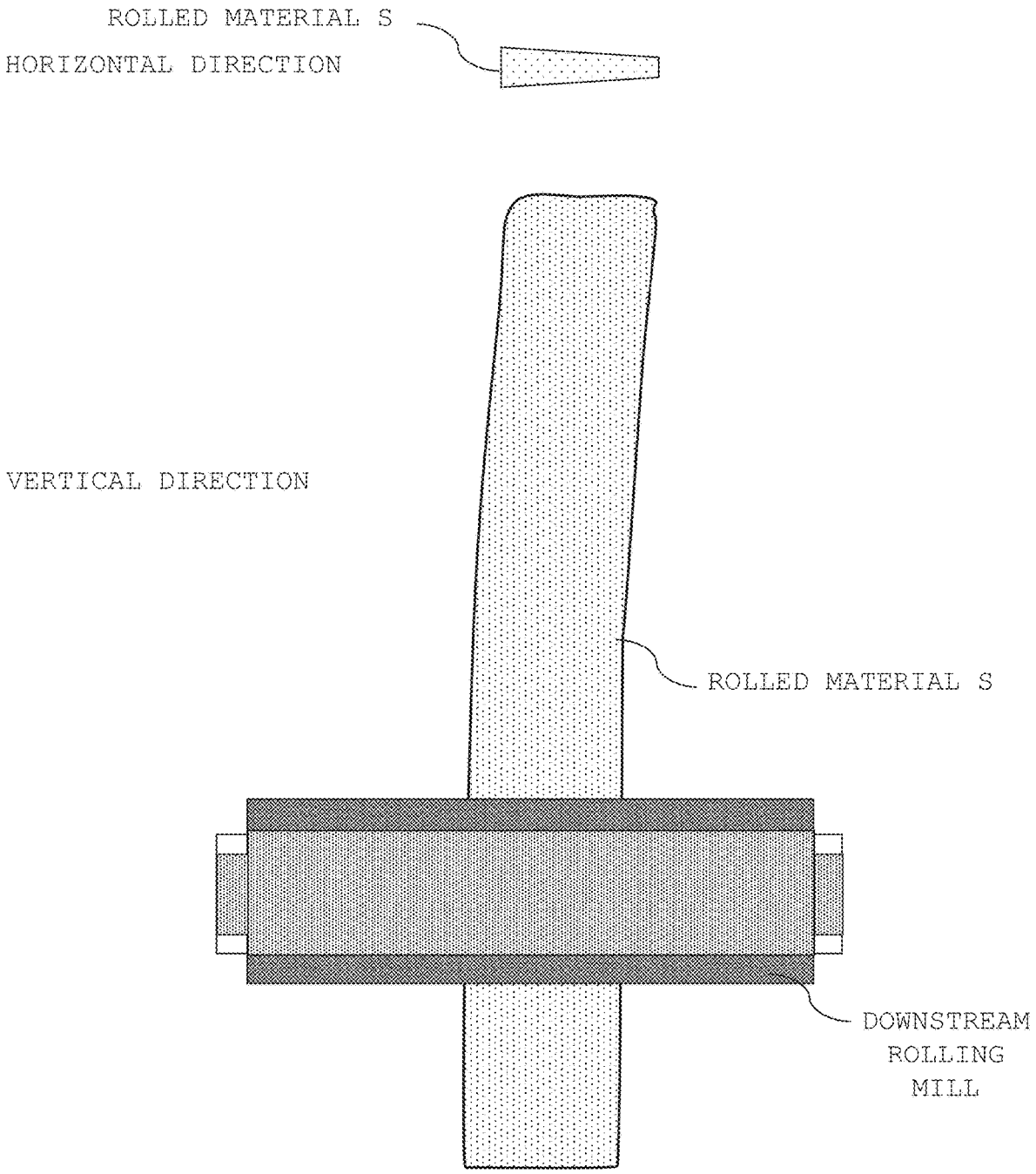
FIG. 5 is a figure depicting a state of the rolled material in a case where rolling is performed with the rolling mill according to the comparative example when the rolled material is off-center.
Figure 6:
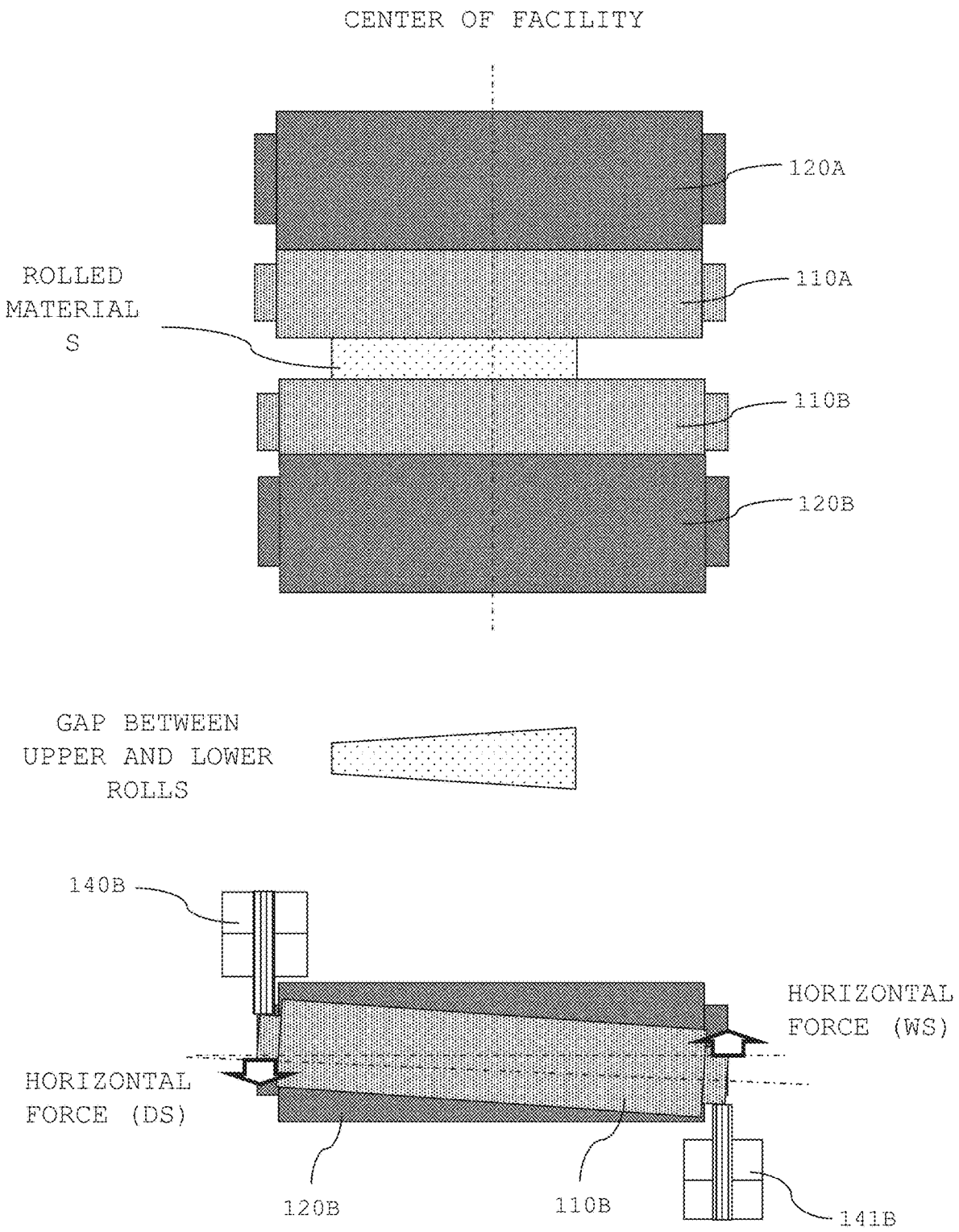
FIG. 6 is a figure depicting a state of a case where the rolled material is off-center in the rolling mill according to the first embodiment.
Figure 7:
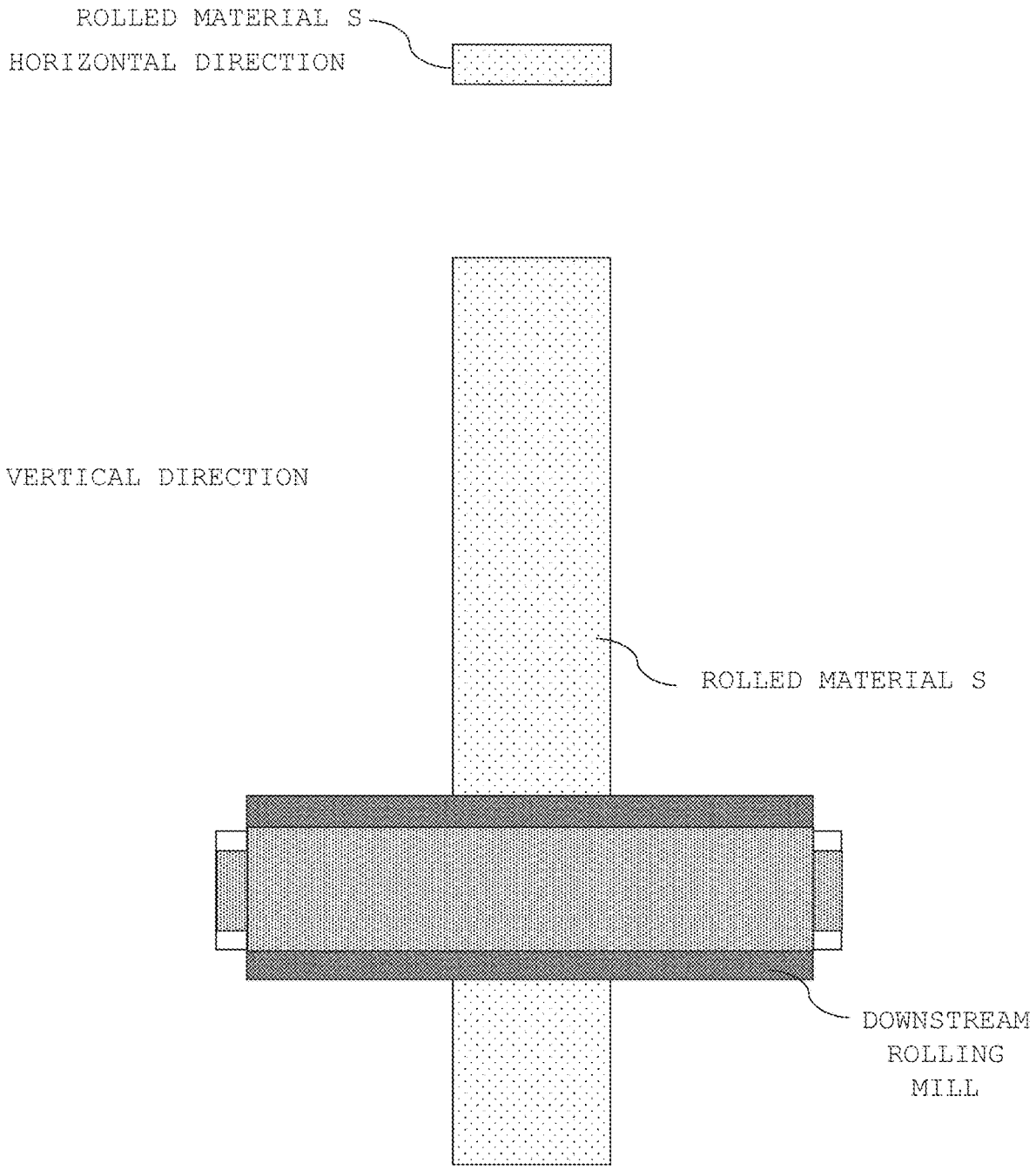
FIG. 7 is a figure depicting a state of the rolled material in a case where rolling is performed with the rolling mill according to the first embodiment when the rolled material is off-center.

Next, advantages of the present embodiment are explained by using FIG. 4 to FIG. 7. FIG. 4 is a figure depicting a state of a case where the rolled material S is off-center in a rolling mill according to a comparative example. FIG. 5 is a figure depicting a state of the rolled material S in a case where rolling is performed with the rolling mill according to the comparative example when the rolled material S is off-center. FIG. 6 is a figure depicting a state of a case where the rolled material S is off-center in the rolling mill according to the first embodiment. FIG. 7 is a state of the rolled material S in a case where rolling is performed with the rolling mill according to the first embodiment when the rolled material S is off-center.

A case where the rolled material S is off-center toward the drive side at a time of rolling is considered.

In this case, as depicted in FIG. 2, the lower work roll 110B receives a moment from the rolled material S, and a restraint moment that is produced due to the rolled material S being rolled by a downstream rolling mill. Further, a horizontal force (WS) is applied to the work-side roll chock 112A retaining the lower work roll 110B in the direction opposite to the rolling direction, and also a horizontal force (DS) is applied to the drive-side roll chock 112B in the rolling direction.

In this case, where position control is performed without causing the work roll 110B and the like to cross, the gap between the upper and lower rolls is narrower on the work side and is wider on the drive side as depicted in FIG. 4.

As a result, as depicted in FIG. 5, a cross-section of the rolled material S after the rolling exhibits a left-right asymmetric shape with a larger thickness on the drive side and a smaller thickness on the work side. Furthermore, due to the larger thickness on the drive side, and the smaller thickness on the work side, the rolled material S becomes longer on the work side as compared with the drive side, and strip elongation occurs; as a result, the degree of strip movement along lateral direction becomes greater undesirably.

However, in the rolling mill 1 according to the first embodiment of the present invention mentioned above, the control device 20 obtains the second pressing forces acting on the work-side and drive-side roll chocks 112A and 112B on the basis of the entry side and exit side first pressing forces, and controls at least one of the work roll position control devices 140B and 141B and at least one of the work roll pressing devices 130B and 131B changing the position of at least one of the roll chocks 112A and 112B in such a manner that the difference between the work-side second pressing force and the drive-side second pressing force is equal to or smaller than the predetermined value.

Thereby, for example, as depicted in FIG. 6, in a case where the rolled material S is off-center toward the drive side, the work roll position control devices 140B and 141B are driven in such a manner that the gap between the upper and lower rolls becomes wider on the work side and narrower on the drive side. More specifically, the work side of the lower work roll 110B is shifted to the exit side of the rolled material S.

Thereby, as depicted in FIG. 7, a cross-section of the rolled material S after the rolling exhibits a left-right symmetric shape with nearly equal thicknesses between on the drive side and the work side, and also it is possible to continue the rolling with the off-center amount of the rolled material being maintained at the same amount or being maintained at a target value.

In this manner, by using the difference between the work-side and drive-side second pressing forces for position control of the roll chocks 112A and 112B in the horizontal direction, it is possible to adjust the positions of the pressing devices in the rolling direction on the basis of the difference between the pressing forces without being influenced by deviations of installation positions that are generated by backlashes in the facility that are present at a time of adjustment of leveling positions and roll cross angle positions described in Patent Documents 1 and 2 mentioned above, and strip wedges can be more easily and precisely controlled as compared with conventional technologies.

In addition, this also attains an advantage that force measurement directions used for control and control directions match, thus it becomes easier for an operator to perform checking, and recognize adjustment directions.

Second Embodiment

Figure 8:
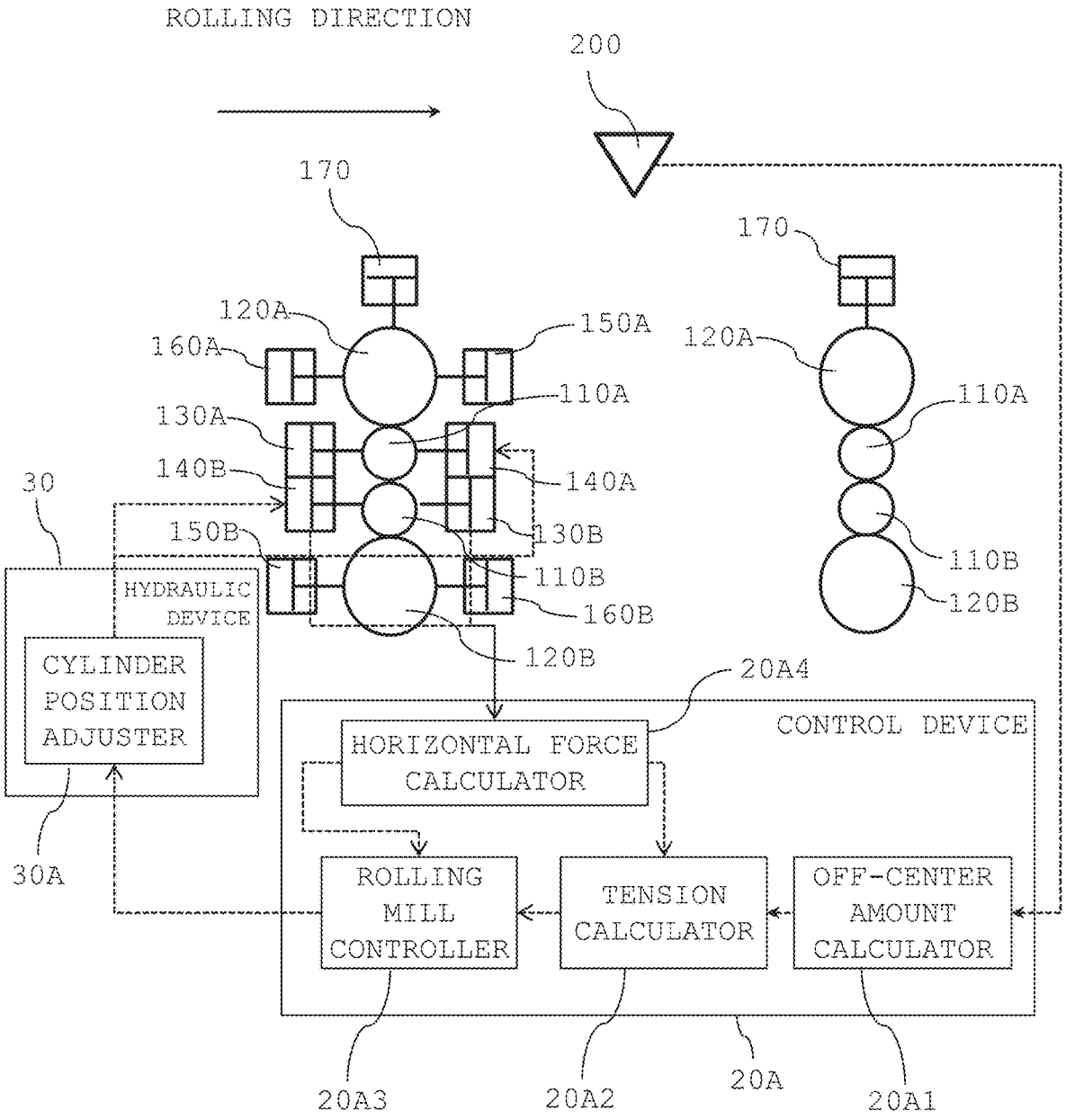
FIG. 8 is a schematic figure depicting the rolling mill according to a second embodiment of the present invention.
Figure 9:
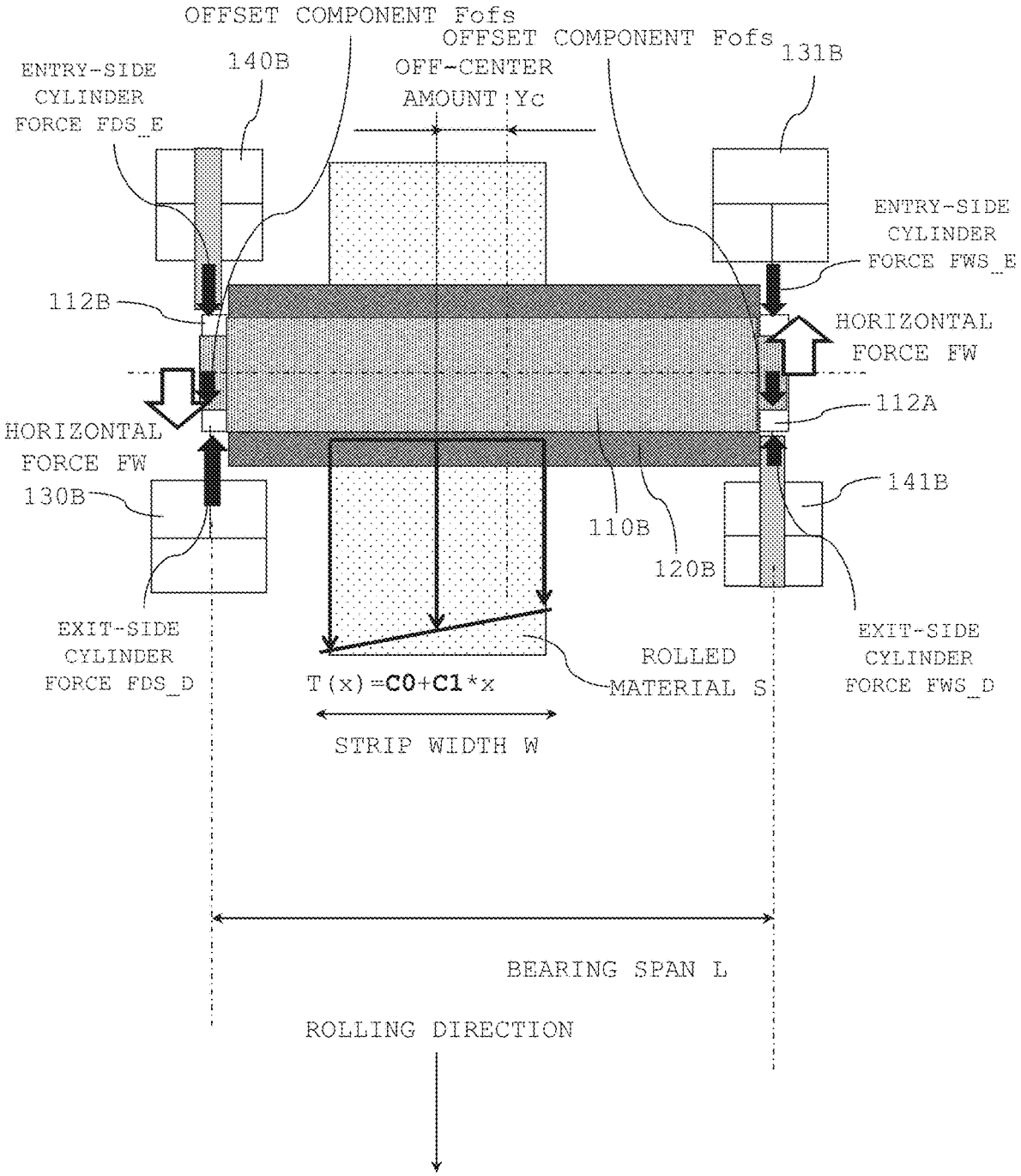
FIG. 9 is a schematic figure depicting a method of computing a tension distribution (first-order: widthwise linear distribution) from an off-center amount (measurement value) and horizontal forces (measurement values) in the rolling mill according to the second embodiment.
Figure 10:
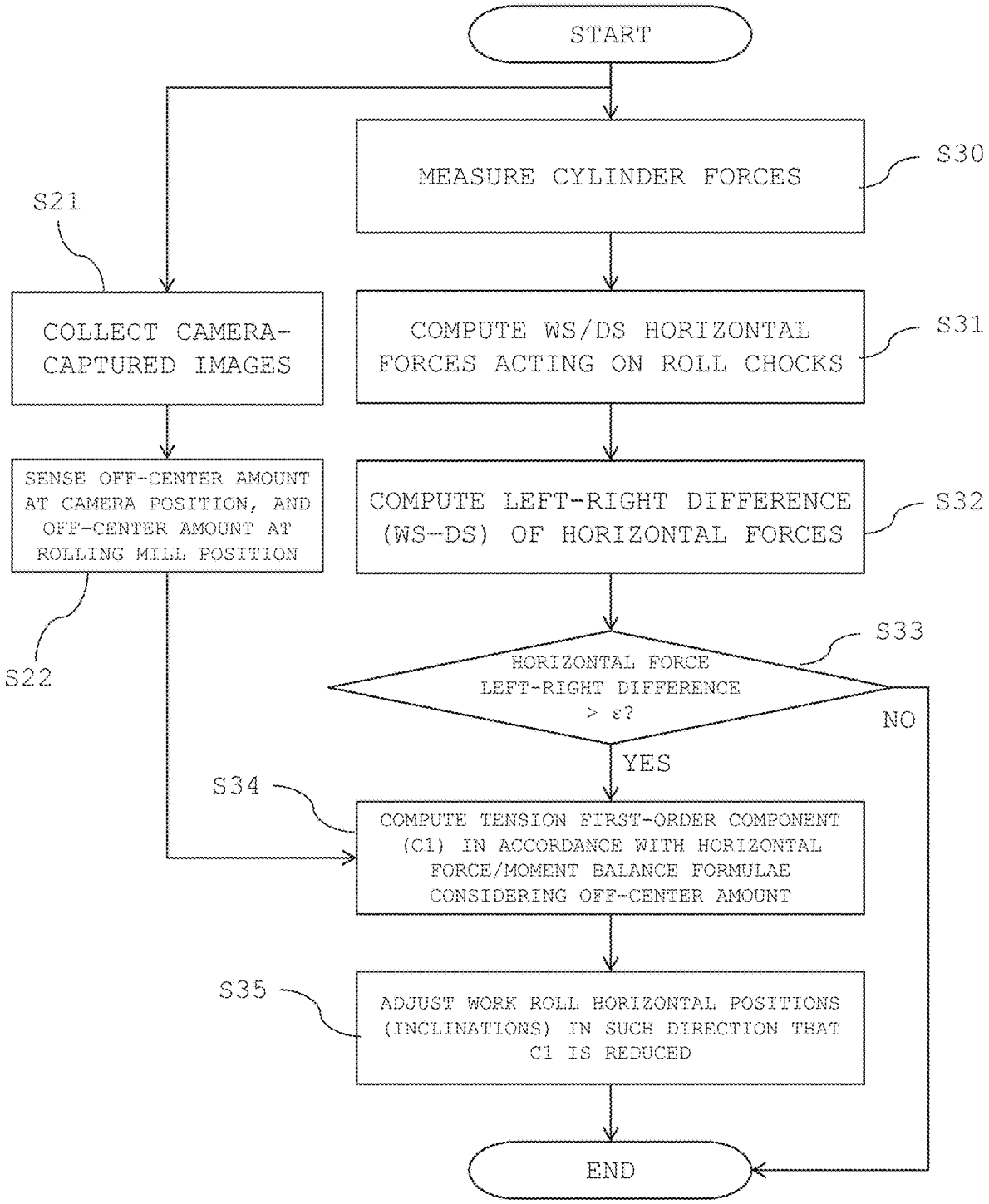
FIG. 10 is a flowchart depicting a procedure of control at a time of rolling in the rolling mill according to the second embodiment.

The rolling mill and rolling method according to a second embodiment of the present invention are explained by using FIG. 8 to FIG. 10. FIG. 8 is a schematic figure depicting the rolling mill according to the present second embodiment. FIG. 9 is a schematic figure depicting a method of computing a tension distribution (first-order: widthwise linear distribution) from an off-center amount (measurement value) and horizontal forces (measurement values). FIG. 10 is a flowchart depicting a procedure of control at a time of rolling.

As depicted in FIG. 8, on the exit side, the rolling mill according to the present embodiment is provided with a camera 200 that captures images of the rolled material S as a tension information acquiring device that acquires information about tension applied to the rolled material S on the exit side of the work rolls 110A and 110B, in addition to the rolling mill 1 according to the first embodiment depicted in FIG. 1.

In addition, in the present embodiment, a control device 20A has an off-center amount calculator 20A1, a tension calculator 20A2, a rolling mill controller 20A3, and a horizontal force calculator 20A4, and obtains a tension distribution in the widthwise direction of the rolled material S on the basis of the entry side and exit side first pressing forces and information about images captured by the camera 200. Furthermore, while the difference between the work-side second pressing force and the drive-side second pressing force is greater than the predetermined value, the work roll position control devices 140B and 141B and the work roll pressing devices 130B and 131B are controlled in such a manner that the position of at least one of the roll chocks 112A and 112B is changed on the basis of the tension distribution.

Here, in the control device 20A according to the present embodiment, the off-center amount calculator 20A1 obtains the amount of deviation between the center of the rolling mill 1 in the widthwise direction and the center of the rolled material S in the widthwise direction, that is, the off-center amount of the rolled material S, on the basis of images of the rolled material S captured by the camera 200.

Furthermore, the tension calculator 20A2 of the control device 20A obtains the tension distribution on the basis of the entry side and exit side first pressing forces, the information and the amount of deviation.

Thereafter, the rolling mill controller 20A3 obtains a work roll horizontal position (inclination) necessary for reducing the first-order component of the tension distribution from the obtained tension distribution.

At this time, the rolling mill controller 20A3 can obtain the tension distribution as a linearly approximated linear equation.

A main cause of the occurrence of a failure of a passing strip such as off-center is a left-right tension difference (first-order component: C1), and it can be known that it is sufficient if the first-order component (C1) can be sensed. Although, other than this, there are also a second-order component (C2) and a fourth (C4)-order component, it is considered that these are less related to the strip movement along lateral direction, thus it is thought that these can be excluded. Furthermore, although there is also a third-order component (C3), the value is small, there are no actuators to control it, thus it can be excluded.

On the other hand, as mentioned later, there is a limitation that only up to two unknown values of a tension distribution formula can be obtained from two known balance formulae (forces: horizontal-force balance formula, moment balance formula).

Accordingly, due to these limitations, unknown values (T0, T1) in $T=T0+T1x$ can be computed as in Formula (1) mentioned later.

Thereafter, a cylinder position adjuster 30A of the hydraulic device 30 obtains a hydraulic fluid volume that should be supplied to a hydraulic cylinder of each position control device such as the work roll position control device 140A or 140B necessary for realizing the obtained inclination, and controls each hydraulic circuit in such a manner that the obtained hydraulic fluid volume is supplied.

Here, by using FIG. 9, a method of computing a tension distribution (first-order: widthwise linear distribution) from an off-center amount (measurement value) and horizontal forces (measurement values) is explained. In the present embodiment, the off-center amount sensed by the camera 200 installed on the exit side of the rolling mill is treated as an off-center amount of the rolled material S at the position of the rolling mill.

The strip tension distribution is represented by Formula (1) described below.

$$T(x)=C_0+C_1*x \quad (1)$$

Here, it is supposed that, when Yc is the off-center amount, and W is the strip width, the following relation is satisfied.

$$-W/2-Yc\leq x\leq W/2-Yc \quad (2)$$

Horizontal forces FD and FW (exit side: defined as positive side) are always computed in accordance with Formula (3) and Formula (4) described below.

$$FD=FDS_D(\text{drive-side exit side cylinder force})-FDS_E(\text{drive-side entry side cylinder force})-Fofs(\text{drive-side offset component})-Fc(\text{drive-side cross force}) \quad (3)$$

$$FW=FWS_D(\text{work-side exit side cylinder force})-FWS_E(\text{work-side entry side cylinder force})-Fofs(\text{work-side offset component})+Fc(\text{work-side cross force}) \quad (4)$$

Note that it is supposed that the cylinder forces are expressed with values obtained by conversion from pressure values.

Furthermore, when a=−W/2−Yc and b=W/2−Yc, the horizontal-force balance formula satisfies the following relation.

$$FD+FW=\int_a^b T(x)dx \quad (5)$$

Accordingly, when c=(L/2−Yc)−W/2 and d=(L/2−Yc)+W/2, $$L*FW=\int_c^d\{T(x)*x\}dx \quad (6)$$

The unknown values (C0, C1) of the tension distribution can be obtained in accordance with Formula (5) and Formula (6) described above.

Next, details of control at a time of rolling in the rolling mill according to the present embodiment and a rolling method are explained with reference to FIG. 10.

Steps S30, S31, S32, and S33 in steps depicted in FIG. 10 are the same as Steps S10, S11, S12, and S13 depicted in FIG. 3, respectively, and details thereof are omitted.

In the present embodiment, as depicted in FIG. 10, in parallel with Steps S30, S31, S32, and S33, the camera 200 captures images of the rolled material S during rolling, and the captured images are collected (Step S21). Step S21 is equivalent to the tension information acquisition step.

Thereafter, the off-center amount calculator 20A1 of the control device 20A senses an off-center amount at the position of the camera 200, and also obtains, from the off-center amount, an off-center amount of the rolled material S at the rolling mill position (Step S22). Step S22 is equivalent to the deviation-amount calculation step.

Next, the tension calculator 20A2 of the control device 20A, by using the horizontal force/moment balance formulae, computes the tension first-order component (C1) from the off-center amount obtained at Step S22, and the horizontal forces obtained at Steps S30 to S32 (Step S34). Step S34 is equivalent to the tension distribution calculation step.

Next, the rolling mill controller 20A3 of the control device 20A and the cylinder position adjuster 30A of the hydraulic device 30 adjust the horizontal positions (inclinations) of the work rolls in such a direction that the tension first-order component obtained at Step S34 is reduced (Step S35), and the process ends.

The rolling mill constantly executes each step depicted in FIG. 10 during rolling.

In other respects, the configuration/operation is approximately the same as the configuration/operation of the rolling mill and rolling method according to the first embodiment mentioned before, and details are omitted.

In the rolling mill and rolling method according to the second embodiment of the present invention also, advantages almost the same as those of the rolling mill and rolling method according to the first embodiment mentioned before are attained.

In addition, the second pressing forces acting on the roll chocks 112A and 112B include components that accompany the strip movement along lateral direction and components that accompany the tension distribution (left-right non-uniformity of tension). In view of this, the tension information acquiring device that acquires information about tension applied to the rolled material S on the exit side of the work rolls 110A and 110B is included further, and the control device 20A obtains the tension distribution in the widthwise direction of the rolled material S on the basis of the entry side and exit side first pressing forces and the information, and controls the work roll position control devices 140B and 141B and the work roll pressing devices 130B and 131B in such a manner that the position of at least one of the roll chocks 112A and 112B is changed on the basis of the tension distribution while the difference is greater than the predetermined value. Thereby, it is possible to more precisely control strip wedges.

Furthermore, the control device 20A obtains the tension distribution on the basis of the entry side and exit side first pressing forces, the information and the amount of deviation between the center of the rolling mill 1 in the widthwise direction and the center of the rolled material S in the widthwise direction. Thereby, it is possible to more precisely obtain the tension distribution from the measured first pressing forces if the components that accompany the strip movement along lateral direction are taken into consideration in a case where the components that accompany the strip movement along lateral direction and the components that accompany the tension distribution are dominant in the second pressing forces acting on the roll chocks 112A and 112B.

In addition, the tension information acquiring device includes the camera 200 that captures images of the rolled material S on at least one of the entry side and the exit side of the rolling mill 1, the information includes the images, and the control device 20A can obtain the amount of deviation on the basis of the images to thereby use a value obtained by directly measuring the off-center amount. Accordingly, it is possible to capture a horizontal force component change that accompanies an off-center change, and to obtain the tension distribution more precisely by taking influence of the horizontal force component change into consideration.

In addition, the control device 20 obtains the tension distribution as the linearly approximated linear equation, and controls the work roll position control devices 140B and 141B and the work roll pressing devices 130B and 131B in such a manner that the first-order component in the linear equation is reduced. Accordingly, it is possible to directly calculate the tension distribution (first-order component) that influences control precision of off-center/strip wedges from the difference between the second pressing forces, and to reduce the tension distribution by position control of the pressing devices, thus it is possible to enhance the performance related to passage of the rolled material S and its quality.

Note that whereas the camera 200 is provided only on the exit side of the subject rolling mill in the case explained, the camera 200 can be provided only on the entry side of the subject rolling mill, in another possible mode. Furthermore, cameras 200 can be provided on both the entry side and the exit side, in another possible mode.

In a case where the cameras 200 are provided on both the entry side and the exit side, the off-center amount calculator 20A1 obtains the amount of deviation between the center of the rolling mill 1 in the widthwise direction and the center of the rolled material S in the widthwise direction, that is, the off-center amount of the rolled material S, on the basis of images of the rolled material S captured by the cameras 200 on the entry side and the exit side.

Such a mode attains an advantage that it becomes possible to take the components that accompany strip movement along lateral direction at the rolling mill position into consideration more accurately, and the tension distribution can be obtained more precisely.

Third Embodiment

Figure 11:
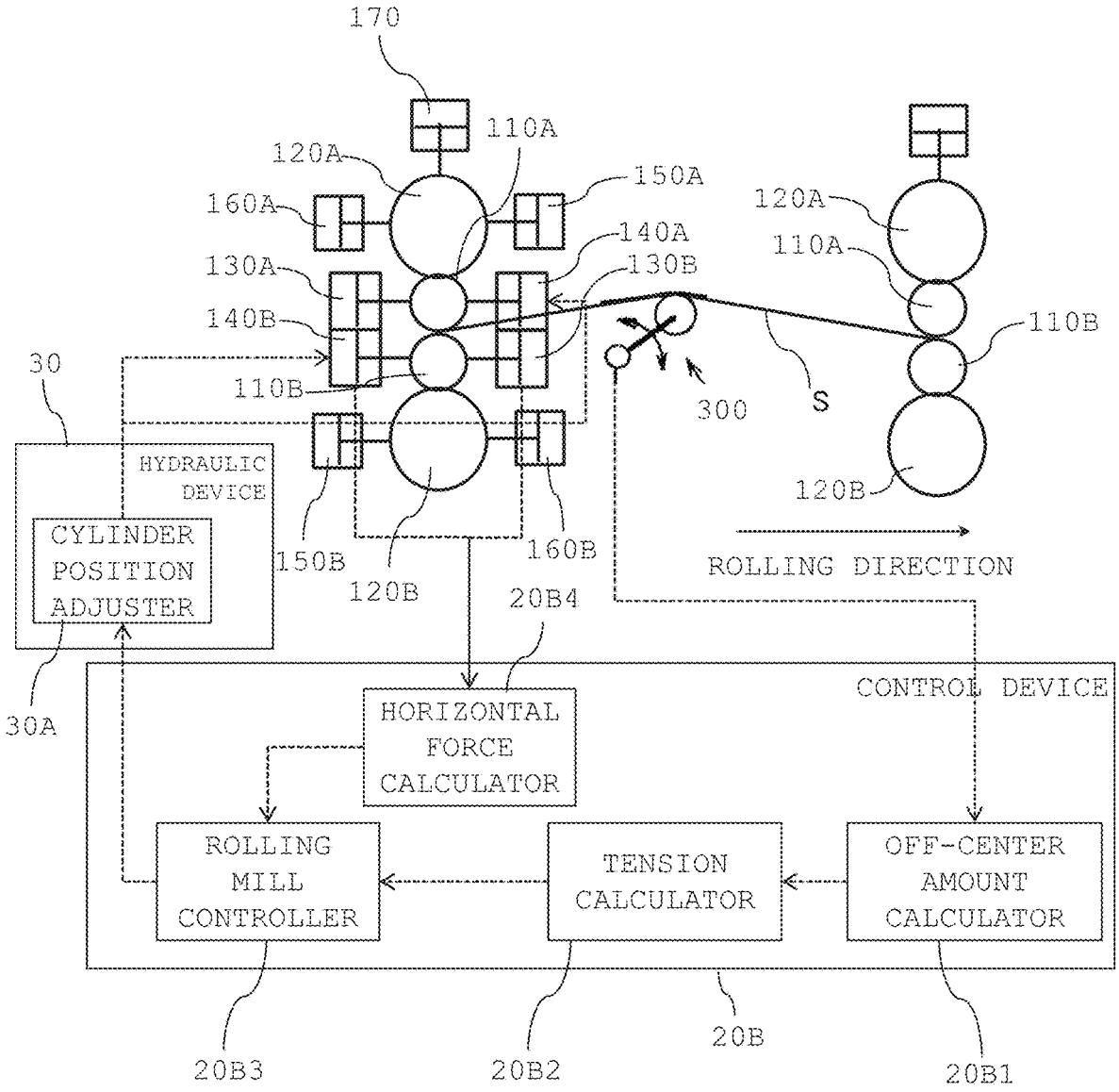
FIG. 11 is a schematic figure depicting the rolling mill according to a third embodiment of the present invention.
Figure 12:
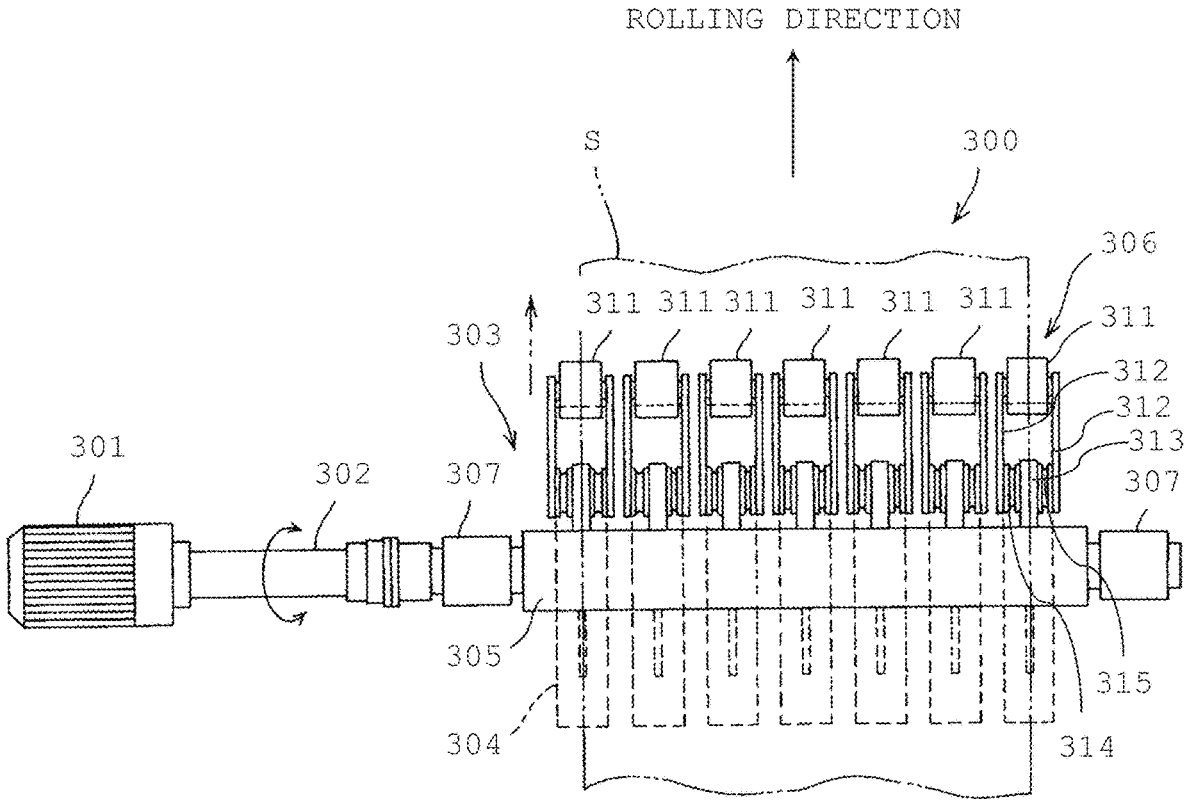
FIG. 12 is a figure depicting an example of the configuration of a shape meter in the rolling mill according to the third embodiment.
Figure 13:
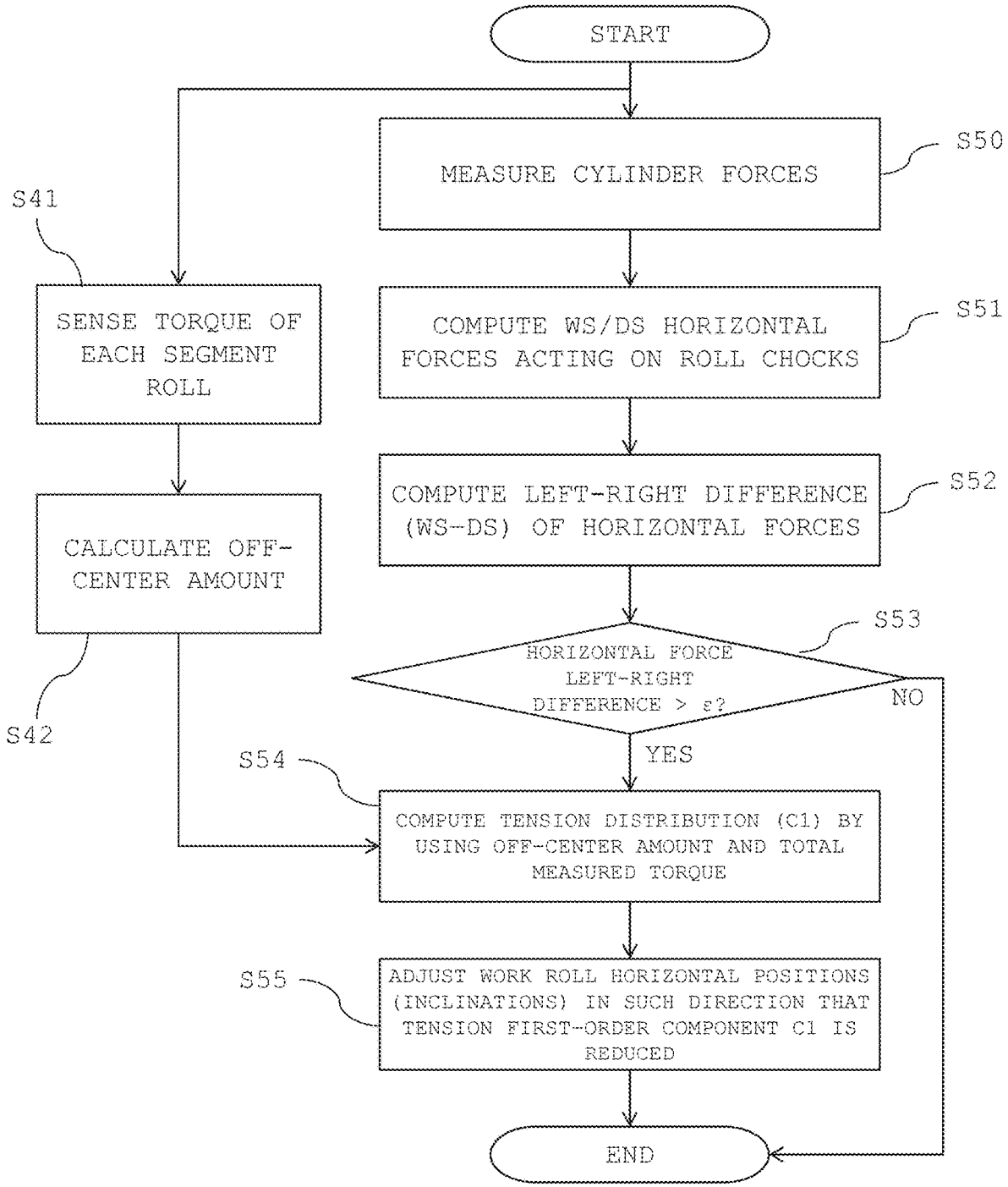
FIG. 13 is a flowchart depicting a procedure of control at a time of rolling in the rolling mill according to the third embodiment.

The rolling mill and rolling method according to a third embodiment of the present invention are explained by using FIG. 11 to FIG. 13. FIG. 11 is a schematic figure depicting the rolling mill according to the present third embodiment. FIG. 12 is a figure depicting an example of the configuration of a shape meter. FIG. 13 is a flowchart depicting a procedure of control at a time of rolling.

As depicted in FIG. 11, on the exit side, the rolling mill according to the present embodiment is provided with a shape meter 300 that acquires a distribution of torque acting on segment rolls 311 from the shape of the rolled material S as a tension information acquiring device that acquires information about tension applied to the rolled material S on the exit side of the work rolls 110A and 110B, in addition to the rolling mill 1 according to the first embodiment depicted in FIG. 1.

In addition, in the present embodiment, a control device 20B has an off-center amount calculator 20B1, a tension calculator 20B2, a rolling mill controller 20B3, and a horizontal force calculator 20B4, and obtains a tension distribution in the widthwise direction of the rolled material S on the basis of the entry side and exit side first pressing forces and information about data of a distribution of torque acting on the segment rolls 311 obtained by the shape meter 300 from the shape of the rolled material S.

As depicted in FIG. 12, the shape meter 300 includes a support shaft 302 that is connected to a drive motor 301 and that extends in the widthwise direction of the rolled material S. The support shaft 302 supports a table 303. The table 303 includes a guide member 304 that guides the rolled material S, and a guide support member 305 that supports the guide member 304, and a surface on the downstream side in the rolling direction of the guide support member 305 supports seven sensors 306. Then, on both sides of the table 303, bearings 307 supported by a frame (illustration omitted) are provided on the support shaft 302.

Each sensor 306 includes: a segment roll 311 that rotates following the rolled material S when in contact with it; a pair of support arms 312 whose ends on one side support the segment roll 311 therebetween; and a fixation member 313 that supports other ends of the support arms 312 and is supported by the guide support member 305 of the table 303.

Each segment roll 311 is rotatably supported between support arms 312 via self-aligning bearings (illustrations omitted) each provided at one end of a support arms 312. In addition, a support shaft (illustration omitted) penetrates each fixation member 313, and ends of the support shaft support self-aligning bearings (illustrations omitted) provided to the other ends of support arms 312. Then, ring-like torque meters 314 and 315 are interposed between the other ends of the support arm 312 and the fixation member 313, and the support shaft penetrates openings of the torque meters 314 and 315. In addition, the torque meters 314 and 315 are connected to the off-center amount calculator 20B1 in the control device 20B.

When the rolled material S comes into contact with a segment roll 311, the load acts on the segment roll 311, and is transferred to the torque meters 314 and 315.

The torque meters 314 and 315 sense the input load as a moment acting on both ends of the segment roll 311, and outputs the moment to the off-center amount calculator 20B1.

The off-center amount calculator 20B1 calculates positions of a strip end of the rolled material S on the segment rolls 311 from input moments, calculates the off-center amount of the rolled material S (the amount of deviation of the center position of the rolled material S in the widthwise direction relative to the passage center position in the roll stand) from the positions of the strip end of the rolled material S, and then outputs the off-center amount to the tension calculator 20B2.

The tension calculator 20B2 calculates a tension distribution on the basis of the off-center amount and the distribution of the measured torque input from the off-center amount calculator 20B1, and outputs the tension distribution to the rolling mill controller 20B3.

The rolling mill controller 20B3 calculates horizontal-position adjustment amounts of the work rolls 110A and 110B and the backup rolls 120A and 120B, and outputs the horizontal-position adjustment amounts to the cylinder position adjuster 30A of the hydraulic device 30.

The cylinder position adjuster 30A of the hydraulic device 30 calculates cylinder positions for realizing the input adjustment amounts, and performs rolling while adjusting the horizontal positions of the work rolls 110A and 110B and the backup rolls 120A and 120B in such a manner that the tension first-order component of the rolled material S is reduced by controlling the work roll position control devices 140B and 141B on the basis of the calculated cylinder positions.

Next, details of control at a time of rolling in the rolling mill according to the present embodiment and a rolling method are explained with reference to FIG. 13.

Steps S50, S51, S52, and S53 in steps depicted in FIG. 13 are approximately the same as Steps S10, S11, S12, and S13 depicted in FIG. 3, respectively, and details thereof are omitted. Note that calculations at Steps S50, S51, S52, and S53 in the present embodiment are executed by the horizontal force calculator 20B4.

In the present embodiment, as depicted in FIG. 13, in parallel with Steps S50, S51, S52, and S53, fourteen torque meters 314 and 315 each provided at both ends of each of the seven segment rolls 311 of the shape meter 300 sense torque, and acquire data of a distribution, in the widthwise direction, of torque acting on the rolled material S (Step S41). Step S41 is equivalent to the tension information acquisition step. Note that it is possible to cause only torque meters 314 and 315 of segment rolls 311 that are within a range contacting the rolled material S to perform sensing at Step S41.

Thereafter, the off-center amount calculator 20B1 of the control device 20B calculates an off-center by using torque sensing values sensed by the torque meters 314 and 315 of the segment rolls 311 in contact with the rolled material S (Step S42). Step S42 is equivalent to the deviation-amount calculation step.

Next, the tension calculator 20B2 of the control device 20B computes the tension first-order component (C1) by using the off-center amount obtained at Step S42 and the total measured torque sensed at Step S41 (Step S54). Step S54 is equivalent to the tension distribution calculation step.

Next, the rolling mill controller 20B3 of the control device 20B and the cylinder position adjuster 30A of the hydraulic device 30 adjust the horizontal positions (inclinations) of the work rolls in such a direction that the tension first-order component obtained at Step S54 is reduced (Step S55), and the process ends.

The rolling mill constantly executes each step depicted in FIG. 13 during rolling.

In other respects, the configuration/operation is approximately the same as the configuration/operation of the rolling mill and rolling method according to the first embodiment mentioned before, and details are omitted.

In the rolling mill and rolling method according to the third embodiment of the present invention also, advantages almost the same as those of the rolling mill and rolling method according to the first embodiment mentioned before are attained.

In addition, the tension information acquiring device includes the shape meter 300 that acquires a distribution of torque acting on the segment rolls 311 from the shape of the rolled material S on at least one of the entry side and the exit side of the rolling mill 1, the information includes data of the distribution of torque acting on the segment rolls 311 obtained from the shape of the rolled material S acquired by the shape meter 300, and the control device 20B can use a value obtained by calculation of the off-center amount also by obtaining the amount of deviation on the basis of the distribution of torque acting on the segment rolls 311. Accordingly, it is possible to capture a horizontal force component change that accompanies an off-center change, and to obtain the tension distribution more precisely by taking influence of the horizontal force component change into consideration. Accordingly, it is possible to realize more precise shape control.

Others

Note that the present invention is not limited to the embodiments described above, and includes various modification examples. The embodiments described above are explained in detail in order to explain the present invention in an easy-to-understand manner, and the present invention is not necessarily limited to those including all the configurations explained.

In addition, it is also possible to replace some of the configurations of an embodiment with configurations of another embodiment, and also it is also possible to add a configuration of an embodiment to the configurations of another embodiment. In addition, also, some of the configurations of each embodiment can also have other configurations additionally, be deleted, or be replaced with other configurations.

For example, whereas cases about a pair cross mill in which a work roll and a backup roll are treated as a pair, and the axes of roll sets of upper and lower pairs cross each other on a horizontal plane are explained in the embodiments mentioned above, the present invention can be applied also to a work roll cross mill in which the axes of upper and lower work rolls cross each other on a horizontal plane.

In addition, whereas the present invention is applied to a four-high rolling mill in the cases explained, the present invention can be applied also to a six high rolling mill, other than a four-high rolling mill.

DESCRIPTION OF REFERENCE CHARACTERS

S: Rolled material
1: Rolling mill
20, 20A, 20B: Control device
20A1, 20B1: Off-center amount calculator
20A2, 20B2: Tension calculator
20A3, 20B3: Rolling mill controller
20A4, 20B4: Horizontal force calculator
30: Hydraulic device
30A: Cylinder position adjuster
100: Housing
110A: Upper work roll
110B: Lower work roll
112A: Work-side roll chock
112B: Drive-side roll chock
120A: Upper backup roll
120B: Lower backup roll
130A, 130B, 131B: Work roll pressing device (pressing device)
140A, 140B, 141B: Work roll position control device (pressing device)
150A, 150B: Backup roll pressing device (pressing device)
160A, 160B: Backup roll position control device (pressing device)
170: Reduction cylinder
180: Load cell
200: Camera (tension information acquiring device)
300: Shape meter (tension information acquiring device)
301: Drive motor
302: Support shaft
303: Table
304: Guide member
305: Guide support member
306: Sensor
307: Bearing
311: Segment roll
312: Support arm
313: Fixation member
314, 315: Torque meter

The invention claimed is:

1. A rolling mill comprising:

a pair of upper and lower work rolls;

roll chocks that rotatably support the work rolls;

a plurality of pressing devices provided on an entry side and an exit side of the roll chocks in a rolling direction, and the plurality of pressing devices being provided on a work side and a drive side, wherein the plurality of pressing devices are configured to be capable of changing positions of the roll chocks in the rolling direction, and measuring first pressing forces on the roll chocks; and a control device that drives the pressing devices, and controls the positions of the roll chocks, the control device being configured to:

obtain second pressing forces acting on the roll chocks on the work side and the drive side on a basis of the first pressing forces on the entry side and the exit side, and drive-control at least one of the plurality of pressing devices changing a position of a roll chock of at least one of the pair of upper and lower work rolls in such a manner that a difference between the second pressing force on the work side and the second pressing force on the drive side is equal to or smaller than a predetermined value; and a tension information acquiring device that acquires information about a tension applied to a rolled material on the exit side of the work rolls, wherein the control device is configured to:

obtain a tension distribution in a widthwise direction of the rolled material on a basis of the information, and control the pressing device on a basis of the tension distribution while the difference is greater than a predetermined value.

2. The rolling mill according to claim 1, wherein the control device is configured to obtain the tension distribution on a basis of the information, and an amount of deviation between a center of the rolling mill in a widthwise direction and a center of the rolled material in the widthwise direction.

3. The rolling mill according to claim 2, wherein the tension information acquiring device includes a camera that captures an image of the rolled material on at least one of the entry side and the exit side of the rolling mill, wherein the information includes the image, and wherein the control device is configured to:

obtain the amount of deviation on a basis of the image, and obtain the tension distribution on a basis of the first pressing forces on the entry side and the exit side, the image, and the amount of deviation.

4. The rolling mill according to claim 2, wherein the tension information acquiring device includes cameras that capture images of the rolled material on the entry side and the exit side of the rolling mill, wherein the information includes the images of the entry side and the exit side, and wherein the control device is configured to:

obtain the amount of deviation on a basis of the images of the entry side and the exit side, and obtain the tension distribution on a basis of the first pressing forces on the entry side and the exit side, the images, and the amount of deviation.

5. The rolling mill according to claim 2, wherein the tension information acquiring device includes a shape meter that acquires data of a distribution, in the widthwise direction of the rolled material, of torque acting from the rolled material on at least one of the entry side and the exit side of the rolling mill, wherein the information includes the data of the torque distribution acquired by the shape meter, and wherein the control device is configured to obtain the amount of deviation on a basis of the data of the distribution of torque.

6. The rolling mill according to claim 1, wherein the control device is configured to obtain the tension distribution as a linearly approximated linear equation, and drive the pressing devices in such a manner that a first-order component of the linear equation is reduced.

7. A method of controlling a rolling mill; the rolling mill including a pair of upper and lower work rolls;

roll chocks that rotatably support the work rolls;

a plurality of pressing devices provided on an entry side and an exit side of the roll chocks in a rolling direction, and the plurality of pressing devices being provided on a work side and a drive side, wherein the plurality of pressing devices are configured to be capable of changing positions of the roll chocks in the rolling direction, and measuring first pressing forces on the roll chocks; and a control device that drives the pressing devices, and controls the positions of the roll chocks, the method comprising:

a pressing force measurement step of measuring the first pressing forces on the roll chocks;

a pressing force calculation step of obtaining second pressing forces acting on the roll chocks on the work side and the drive side on a basis of the first pressing forces on the entry side and the exit side;

a difference calculation step of obtaining a difference between the second pressing force on the work side and the second pressing force on the drive side;

a press control step of drive-controlling at least one of the plurality of pressing devices changing a position of a roll chock of at least one of the pair of upper and lower work rolls in such a manner that the difference is equal to or smaller than a predetermined value;

a tension information acquisition step of acquiring information about a tension applied to a rolled material on the exit side of the work rolls; and a tension distribution calculation step of obtaining a tension distribution in a widthwise direction of the rolled material on a basis of the information, wherein at the press control step, the pressing device is controlled on a basis of the tension distribution while the difference is greater than a predetermined value.

8. The method of controlling the rolling mill according to claim 7, further comprising:

a deviation-amount calculation step of obtaining an amount of deviation between a center of the rolling mill in a widthwise direction and a center of the rolled material in the widthwise direction, wherein at the tension distribution calculation step, the tension distribution is obtained on a basis of the information and the amount of deviation.

9. The method of controlling the rolling mill according to claim 8, wherein the information includes an image of the rolled material on at least one of the entry side and the exit side of the work rolls that is captured by a camera, wherein at the deviation-amount calculation step, the amount of deviation is obtained on a basis of the image, and wherein at the tension distribution calculation step, the tension distribution is obtained on a basis of the first pressing forces on the entry side and the exit side, the image and the amount of deviation.

10. The method of controlling the rolling mill according to claim 8, wherein the information includes images of the rolled material on the entry side and the exit side of the work rolls that are captured by cameras, wherein at the deviation-amount calculation step, the amount of deviation is obtained on a basis of the images of the entry side and the exit side, and wherein at the tension distribution calculation step, the tension distribution is obtained on a basis of the first pressing forces on the entry side and the exit side, the images and the amount of deviation.

11. The method of controlling the rolling mill according to claim 8, wherein the information includes data of a distribution, in the widthwise direction of the rolled material, of torque acting from the rolled material on at least one of the entry side and the exit side of the rolling mill, the data being acquired by a shape meter, and wherein at the deviation-amount calculation step, the amount of deviation is obtained on a basis of the data of the distribution of torque.

12. The method of controlling the rolling mill according to claim 7, wherein at the tension distribution calculation step, the tension distribution is obtained as a linearly approximated linear equation, and wherein at the press control step, the pressing devices are driven in such a manner that a first-order component of the linear equation is reduced.

* * * * *